US011817615B2

(12) United States Patent
Campbell et al.

(10) Patent No.: US 11,817,615 B2
(45) Date of Patent: Nov. 14, 2023

(54) UNIVERSAL REMOTE RADIO UNIT MOUNTING ASSEMBLIES

(71) Applicant: CommScope Technologies LLC, Hickory, NC (US)

(72) Inventors: Robert Campbell, Irving, TX (US); Matthew Severin, Grapevine, TX (US); Jyoti Ojha, Southlake, TX (US); Dale Richard Heath, Fort Worth, TX (US); Michael R. Carnes, Euless, TX (US); Brian D. Cross, Double Oak, TX (US); Salvador Anguiano, Fort Worth, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/539,842

(22) Filed: Dec. 1, 2021

(65) Prior Publication Data

US 2022/0190462 A1 Jun. 16, 2022

Related U.S. Application Data

(60) Provisional application No. 63/123,606, filed on Dec. 10, 2020.

(51) Int. Cl.
*H01Q 1/12* (2006.01)

(52) U.S. Cl.
CPC ..... *H01Q 1/1228* (2013.01); *H01Q 1/125* (2013.01)

(58) Field of Classification Search
CPC ..... H01Q 1/1228; H01Q 1/125
See application file for complete search history.

(56) References Cited

U.S. PATENT DOCUMENTS

| | | | | |
|---|---|---|---|---|
| 2,846,570 | A * | 8/1958 | Harling | F21V 21/116 362/396 |
| 10,797,380 | B2 | 10/2020 | Roy et al. | |
| 2010/0038501 | A1* | 2/2010 | Oh | F16M 11/10 248/220.21 |
| 2015/0144758 | A1* | 5/2015 | Kolokotronis | H01Q 1/1228 248/282.1 |
| 2015/0364876 | A1* | 12/2015 | Grandidge | G02B 6/4454 439/544 |
| 2020/0119537 | A1* | 4/2020 | Heath | H02G 7/20 |
| 2022/0344798 | A1* | 10/2022 | Park | H01Q 3/06 |

FOREIGN PATENT DOCUMENTS

| | | | | |
|---|---|---|---|---|
| WO | WO-2012094890 | A1 * | 7/2012 | F16M 13/02 |

* cited by examiner

*Primary Examiner* — Awat M Salih
(74) *Attorney, Agent, or Firm* — Myers Bigel, P.A.

(57) ABSTRACT

The present disclosure describes a mounting bracket for remote radio unit mounting assemblies. The mounting bracket includes a bracket member having a main body section and two arms extending outwardly at an oblique angle from opposing ends of the main body section, wherein the main body section includes a slot and each arm includes a plurality of mounting apertures; and a brace member, wherein a middle section of the brace member is configured to be received within the slot of the bracket member and opposing end sections of the brace member contact a respective arm of the bracket member. Remote radio unit mounting assemblies are also described herein.

14 Claims, 13 Drawing Sheets

UNIVERSAL REMOTE RADIO UNIT MOUNTING ASSEMBLIES

RELATED APPLICATION(S)

The present application claims priority to and the benefit of U.S. Provisional Patent Application Ser. No. 63/123,606, filed Dec. 10, 2020, the disclosure of which is hereby incorporated herein in full.

FIELD

The present application is directed generally to the mounting of electronic components, and more specifically to the mounting of remote radio units.

BACKGROUND

With increased demand for more wireless communication, the number of radio and antenna units that a tower traditionally supports has increased and is expected to continue to increase. New towers will need to be designed to support greater numbers of antenna and radio units, while existing towers are retrofitted to support more units, and effort is made to fully utilize space available on the towers.

Often, remote radio units (RRUs) are mounted on legs of antenna towers. In some instances, it may be desirable to mount two or more RRUs on a single mounting location. It also may be desirable to mount a complimentary module adjacent the RRUs.

SUMMARY

One embodiment of the present invention is directed to a mounting bracket. The mounting bracket may include a bracket member having a main body section and two arms extending outwardly at an oblique angle from opposing ends of the main body section, wherein the main body section includes a slot and each arm includes a plurality of mounting apertures; and a brace member, wherein a middle section of the brace member is configured to be received within the slot of the bracket member and opposing end sections of the brace member contact a respective arm of the bracket member Another embodiment of the present invention is directed to an assembly for mounting one or more remote radio units to a mounting structure. The assembly may include first and second mounting panels, each of the first and second mounting panels having a main body and a flange that extends generally perpendicularly to the main body, the main body including mounting apertures patterned for mounting of a remote radio unit; a mounting bracket having a bracket section and a brace section, wherein the bracket section includes a plurality of open-ended slots and mounting holes; mounting members extending from the flanges away from the main body of each of the first and second mounting panels, wherein one mounting member for each mounting panel is configured to enter a corresponding open-ended slot on the mounting bracket and slide therein and another mounting member for each mounting panel is configured to be received through a corresponding mounting hole; and fasteners cooperating with the mounting members to mount the first and second mounting panels to the mounting bracket.

Another embodiment of the present invention is directed to a remote radio unit mounting assembly. The assembly may include first and second remote radio units; a mounting structure; a mounting bracket secured to the mounting structure, the mounting bracket having a bracket section and a brace section, wherein the bracket section includes a plurality of open-ended slots and mounting holes; first and second mounting panels, each of the first and second mounting panels having a main body and a flange that extends generally perpendicularly to the main body, the main body including mounting apertures patterned for mounting of the remote radio units; mounting members extending from the flanges away from the main body of each of the first and second mounting panels, wherein one mounting member for each mounting panel is received within a corresponding open-ended slot on the mounting bracket and another mounting member for each mounting panel is received through a corresponding mounting hole; and fasteners cooperating with the mounting members to mount the first and second mounting panels to the mounting bracket, wherein the first and second remote radio units are mounted on a respective mounting panel.

Another embodiment of the present invention is directed to a remote radio unit mount. The remote radio unit mount may include a pair of saddle brackets, each saddle bracket having a main body and a pair of angle brackets coupled to the main body; and a mounting pole secured to each angle brackets via a respective fastener, wherein the saddle brackets are configured to be secured to corresponding pipe clamps to secure the remote radio unit mount within an interior space of an antenna tower.

Another embodiment of the present invention is directed to a remote radio unit mounting assembly. The assembly may include one or more remote radio units; a mounting structure, wherein the mounting structure is an antenna tower; and a remote radio unit mount. The mount may include a pair of saddle brackets, each saddle bracket having a main body and a pair of angle brackets coupled to the main body; and a mounting pole secured to each angle brackets via a respective fastener, wherein the one or more remote radio units are mounted on the mounting pole, and wherein the saddle brackets are secured to corresponding pipe clamps to secure the remote radio unit mount to a leg of an antenna tower such that the remote radio unit mount extends radially inward from the leg of the antenna tower.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

DETAILED DESCRIPTION

Figure 1:
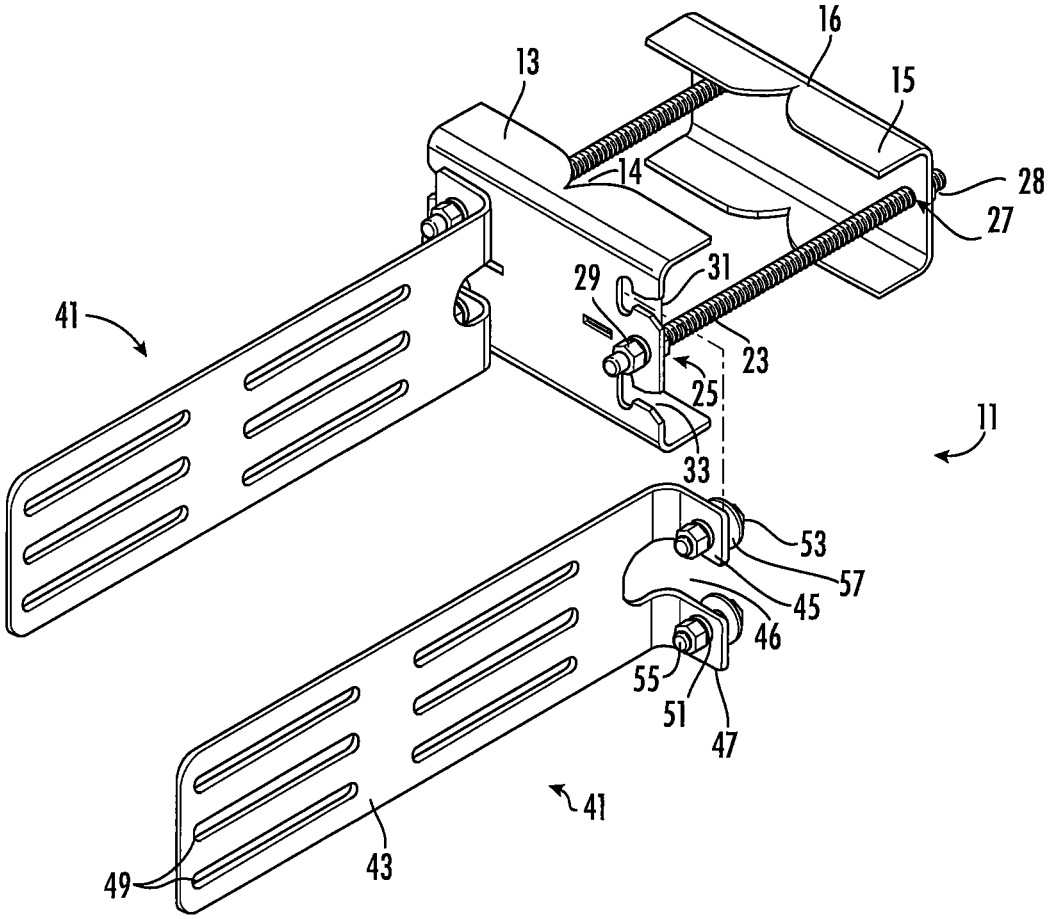
FIG. 1 is a partially exploded perspective view of an RRU mounting assembly according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Referring now to the figures, a remote radio unit mounting assembly, designated broadly at 11, is illustrated in FIG. 1. As shown in FIG. 1, the assembly 11 includes generally U-shaped front and rear pipe clamps 13, 15. The front and rear pipe clamps 13, 15 are held together by two threaded bolts or rods 23 that are inserted through aligned holes 25, 27 located near the edges of the pipe clamps 13, 15 and secured with nuts 28, 29. Tightening of the bolts 23 enables the pipe clamps 13, 15 to clamp the leg of an antenna tower, with the tower leg being held between the recesses 14, 16 in the pipe clamps 13, 15.

In some embodiments, the rear pipe clamp 15 may be shorter than the front pipe clamp 13; for example, the rear pipe clamp 15 may be 4 inches in height, whereas the front clamp 13 may be 6 inches in height. The bolts 23 are typically of sufficient length that the front and rear pipe clamps 13, 15 may clamp around a mounting structure 150, such as the leg of an antenna tower, that is between about 2 and 20 inches in diameter. Structures other than antenna tower legs, such as antenna frames, antenna pipes, monopoles, street poles, light poles, sector frames, telecommunications racks, and the like, may also serve as suitable mounting structures 150 for the assembly 11.

The front pipe clamp 13 includes two open ended slots 31, 33 on each side edge, with one slot 31 located above the hole 25 and the other slot 33 located below the hole 25. The slots 31, 33 are generally T-shaped.

Still referring to FIG. 1, the RRU mounting assembly 11 includes two L-shaped mounting panels 41, each of which has a main body 43 and two flanges 45, 47 with a gap 46 between the flanges 45, 47. The main body 43 includes three rows of two aligned elongate slots 49, with the rows of slots 49 being separated from each other by about 1.5 inches. Each of the flanges 45, 47 has a hole 51 that receives a bolt 53. The bolt 53 is threaded through an optional washer 57 into a nut 55. The bolts 53 are vertically spaced from each other essentially the same distance as the slots 31, 33 of the front pipe clamp 13. The bolts 53 are threaded into the nuts 55, and the bolts 53 are slid into the open ended slots 31, 33. The T-shape of the slots 31, 33 enables the bolts 53 to slide inwardly, then descend to the lowest ends of the slots 31, 33. The gap 46 prevents the bolts 23 of the pipe clamps 13, 15 from interfering with the sliding action. The nuts 55 can then be tightened to secure the flanges 45, 47 to the front pipe clamp 13.

Figure 2:
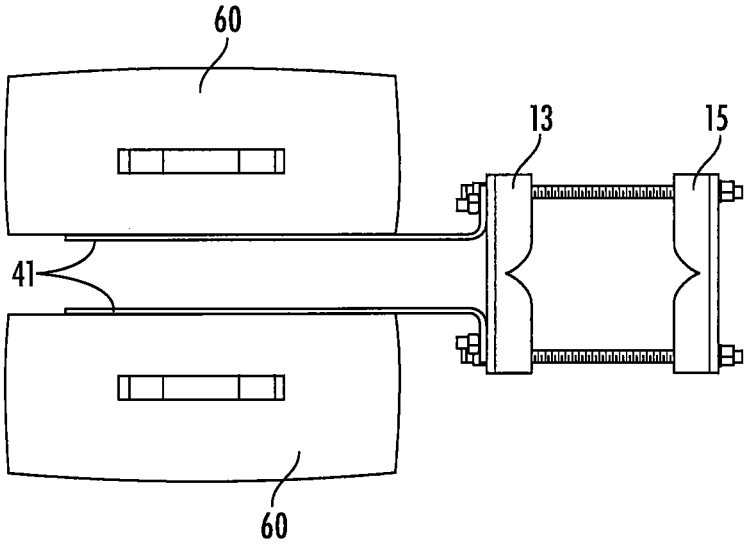
FIG. 2 is a top view of the mounting assembly of FIG. 1 with the mounting panels oriented with the flanges extending outwardly, and with two RRUs mounted thereon.

The configuration of the front pipe clamp 13 and the mounting panels 41 enables the mounting panels 41 to be mounted either closely spaced from each other or more distantly spaced from each other. In each instance, the same process of sliding the threaded bolts 53 with nuts 55 thereon into the slots 31, 33 is followed. If the mounting panels 41 are in the orientation shown in FIG. 2 (i.e., with the flanges 45, 47 extending laterally, so that the flanges 45, 47 of the pair of mounting panels 41 extend away from each other), the mounting panels 41 are closely spaced from one other (typically between about 2 and 3 inches apart). In this orientation, the mounting panels 41 can provide mounting locations for two RRUs 60 in a "back-to-back" configuration, as shown in FIG. 2 (see also FIG. 6A).

Figure 3:
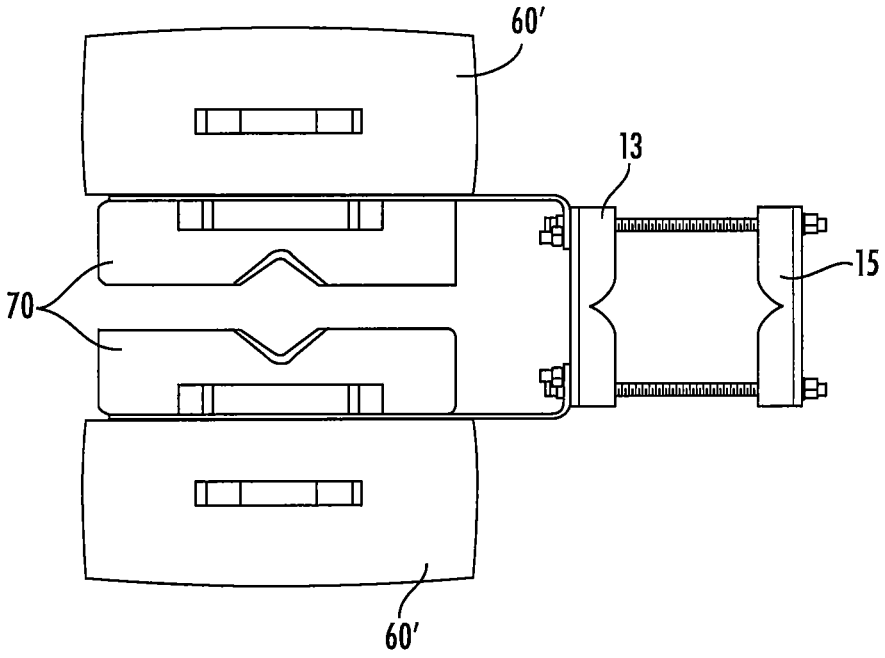
FIG. 3 is a top view of the mounting assembly of FIG. 1 with the mounting panels oriented with the flanges extending inwardly, and with two RRUs and two A2 modules mounted thereon.

If instead the mounting panels 41 are in the orientation shown in FIG. 3 (i.e., with the flanges 45, 47 extending inwardly toward the flanges 45, 47 of the other mounting panel 41), the mounting panels 41 are more distantly spaced from each other (i.e., between about 7 inches and 9 inches apart). In this orientation, the mounting panels 41 can provide mounting locations for two RRUs 60', with one RRU 60' located laterally from each mounting panel 41, and also for two A2 modules 70 sandwiched between the mounting panels 41, with one A2 module 70 mounted to each mounting panel 41, as shown in FIG. 3 (see also FIG. 7A).

It should also be noted that the configuration of the front pipe clamp 13 and the mounting panels 41 can facilitate mounting. In one mounting technique, the mounting panel 41 is first attached to an RRU 60, 60' (and to an A2 module 70, if included) with fasteners (e.g., bolts or screws) inserted through the slots 49, and the nuts 55 can be threaded onto the bolts 53 as they extend through the holes 51. These steps can be completed on the ground. Separately, the front and rear clamps 13, 15 are installed onto a mounting structure, such as the leg of an antenna tower. The RRU 60, 60' and attached mounting panel 41 can then be conveyed up the tower to the mounting location, where the bolts 53 are slid into the open ends of the slots 31, 33 of the front pipe clamp 13 and to the lowest ends of the slots 31, 33. The nuts 55 can then be tightened on the bolts 53 to secure the mounting panel 41 (and in turn the RRU 60, 60') to the front pipe clamp 13. This technique reduces the degree to which the technician has to support and maneuver the RRU 60, 60' while positioned on the tower well above the ground.

Those skilled in this art will appreciate that the configuration of the mounting assembly 11 can vary. For example, in some embodiments the slots 31, 33 of the front pipe clamp 13 may be straight, arcuate, or even L-shaped rather than T-shaped. The front pipe clamp 13 may be mounted to the antenna tower or other mounting structure in a different manner or, on some embodiments, a component other than a front pipe clamp may serve as a mounting foundation.

In other embodiments, the configuration of the mounting panels 41 may vary. Additional flanges may be included, and/or the gap 46 may be omitted so that only a single large flange is present. The slots 49 in the main body 43 of the mounting panel 41 may be apertures of a different configuration and/or pattern, or may be omitted altogether, with another technique for mounting an RRU 60, 60' to the mounting panel 41 (such as hooks stamped from the main body) used.

Further, in some embodiments the bolts 53 may be replaced as mounting members. For example, rather than using a separate and distinct component, such as a bolt, a threaded post may be fixed to and extend from each flange. It can also be envisioned that other varieties of fasteners (e.g., clamps and the like) may be employed to secure the bolts or other mounting members to the front pipe clamp 13.

In some embodiments, additional components may be mounted to the mounting panels 41 to provide the technician with more flexibility in mounting the RRUs 60, 60' and/or A2 modules 70. These additional components are described in U.S. Pat. No. 10,797,380 to Roy et al., the disclosure of which is hereby incorporated by reference herein in its entirety.

Figure 4A:
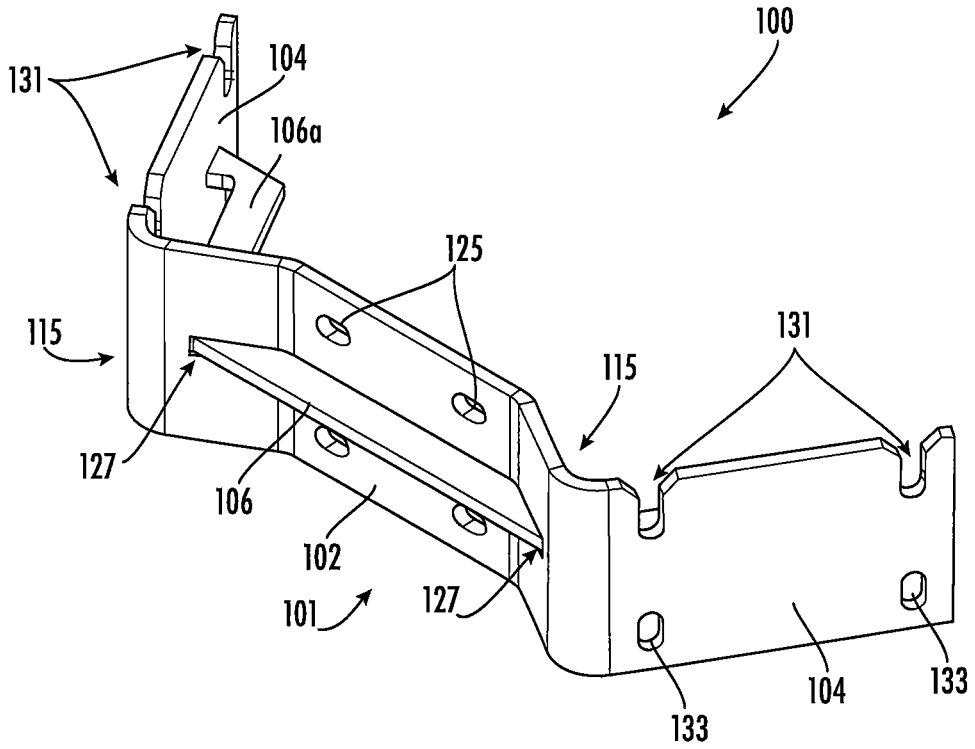
FIG. 4A is a perspective view of a mounting bracket for an RRU mounting assembly according to embodiments of the present invention.
Figure 4B:
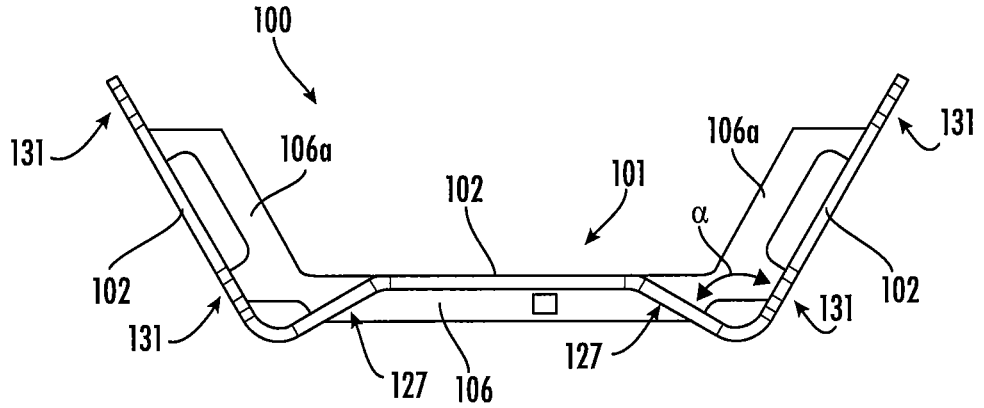
FIG. 4B is a top view of the mounting bracket of FIG. 4A.
Figure 4C:
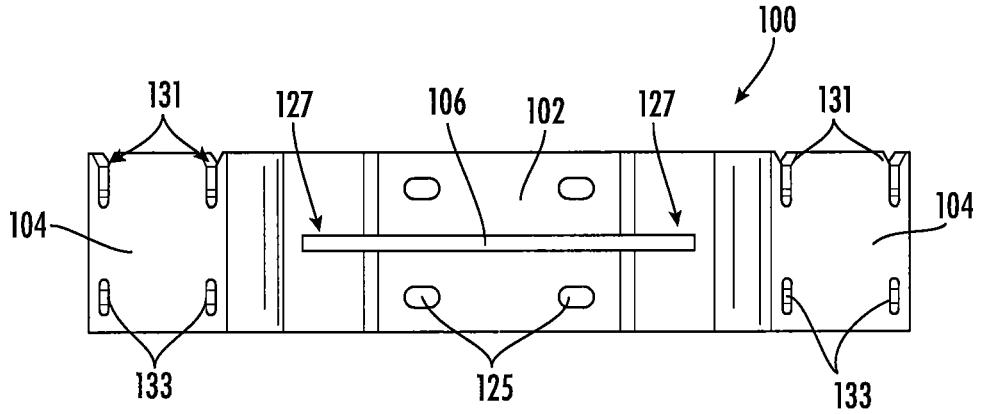
FIG. 4C is a front view of the mounting bracket of FIG. 4A.

Referring now to FIGS. 4A-7B, according to embodiments of the present invention, the front and rear pipe clamps 13, 15 of the RRU mounting assembly 11 may be replaced with mounting bracket 100 (FIGS. 4A-4C). As shown in FIGS. 4A-4C, the mounting bracket 100 may be a weldment that includes a bracket member 101 and a brace member 106. In some embodiments, the bracket member 102 may be generally W-shaped having a main body section 102 and two arms 104 extending outwardly at an oblique angle (a) from opposing ends of the main body section 102. In some embodiments, the bracket member 102 may further have a transition section 115 between the main body section 102 and each arm 104. In some embodiments, the bracket member 102 is monolithic. For example, the bracket member 101 may be formed from a single piece of steel and bent to create the desired W-shape of the mounting bracket 100. In some embodiments, the arms 104 may extend at an angle (a) of about 25 degrees to about 45 degrees relative to the main body section 102. For example, in some embodiments, each arm 104 extends outwardly at an angle ($\alpha$) of 30 degrees, respectively, and the total interior angle between the arms 104 is 120 degrees One parameter that influences the design of telecommunications equipment is Effective Projected Area (EPA), which is determined by calculations defined by TIA/ANSI-222-G. EPA is intended to predict the effect of wind loading on a telecommunications structure to enable designers to create a safe design. The configuration of the RRU mount can impact the calculations. As such, minimizing the RRU mount's contribution to EPA is desirable. According to embodiments of the present invention, the W-shaped design of the bracket member 102 of the mounting bracket 100 allows the RRUs 60, 60' (and A2 modules 70, if included) mounted to the mounting bracket 100 to reside on either side of the leg 150*a* of an antenna tower 150 that the corresponding antenna mount 90 (e.g., a sector frame mount) is mounted thereon (see, e.g., FIG. 8 and FIGS. 9A-9B). As discussed in further detail below, the shape of the mounting bracket 100 allows more RRUs 60, 60' to be mounted on a single mounting structure 150. The W-shaped design also allows the mounting bracket 100 (and mounted RRUs 60, 60') to be secured as close to the antenna tower as possible, thereby reducing EPA of the RRU mounting assembly 11, 111. Due to the angle of the RRUs 60, 60', the side EPA cross-section is reduced to the horizontal application of wind in comparison with other known RRU mounts.

Still referring to FIGS. 4A-4C, the main body section 102 of the bracket member 101 includes a plurality of mounting holes 125. The mounting holes 125 are sized and configured to receive fasteners 130 (e.g., U-bolts) (see also, e.g., FIGS. 5, 6A, and 7A). For example, in some embodiments, the main body section 102 may include two pairs of mounting holes 125, each pair of mounting holes 125 being configured to receive a respective U-bolt. These fasteners 130 will be used to secure the mounting bracket 100 to a mounting structure 150 (see, e.g., FIG. 6B and FIG. 7B).

The main body section 102 (and transition sections 115) further includes a slot 127 that is sized and configured to receive the brace member 106. In some embodiments, the slot 127 may extend along a central axis of the main body section 102 (and into the transition sections 115). As shown in FIG. 4B, the brace member 106 has opposing arms 106*a* that are bent such that the brace member 106 matches the oblique angle ($\alpha$) (or bend profile) of the arms 104 of the bracket member 101. The brace member 106 may be slid into the slot 127 and secured (e.g., welded) to the bracket member 101. The brace member 106 provides increase stability and structural support to the mounting bracket 100.

As shown in FIGS. 4A and 4C, the arms 104 of the bracket member 101 include a pair of open-ended slots 131 and corresponding holes 133. Each slot 131 and hole 133 pair is configured to secure a respective mounting panel 41 to the mounting bracket 100. As discussed above, each of the flanges 45, 47 of the mounting panel 41 has a hole 51 that receives a bolt 53. First, a bolt 53 is threaded through an optional washer 57 into a nut 55 and inserted through the hole 51 in (top) flange 45 of a respective mounting panel 41. The bolt 53 is slid into one of the open-ended slots 131. The open-end slot 131 enables the bolt 53 to slide and descend to the lowest end of the slot 131. The hole 51 in (bottom) flange 47 is then aligned with the corresponding hole 133 in the mounting bracket 100 and another bolt 53 is threaded through an optional washer 57 and inserted through the aligned holes 51, 133 into a nut 55. The nuts 55 can then be tightened to secure the flanges 45, 47 to the mounting bracket 100. Another mounting panel 41 may then secured to the mounting bracket 100 in a similar manner using the other slot 131 and hole 133 pair (FIG. 5).

Figure 5:
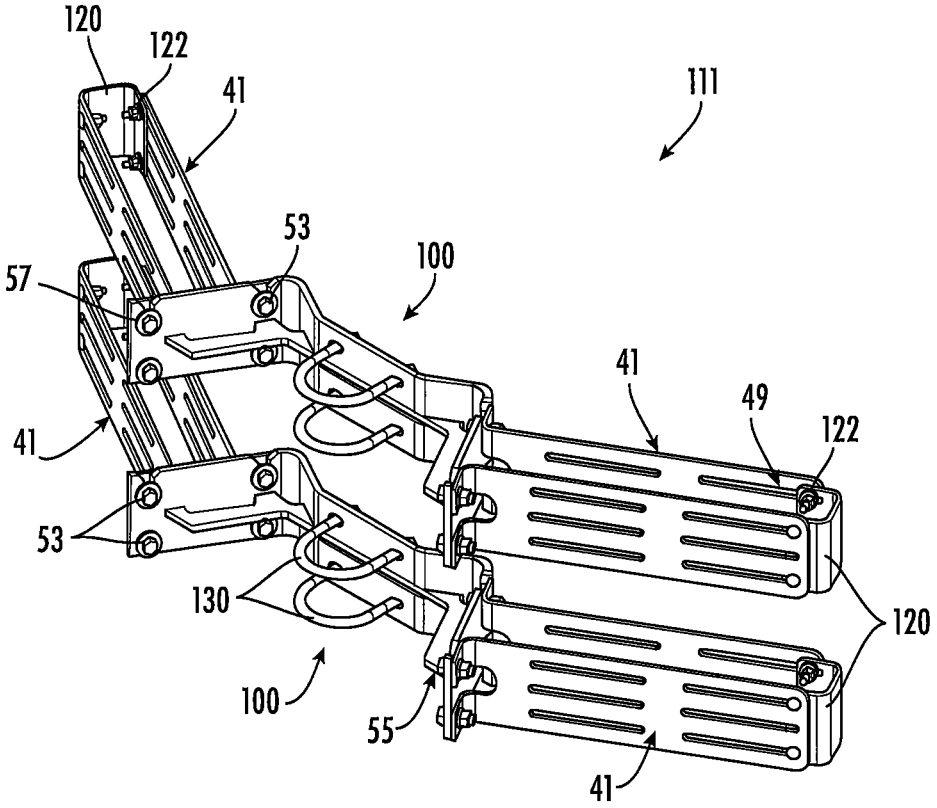
FIG. 5 is a perspective view of an RRU mounting assembly utilizing the mounting bracket of FIGS. 4A-4C according to embodiments of the present invention.

Referring now to FIG. 5, two RRU mounting assemblies utilizing the mounting bracket 100 described herein, designated broadly at 111, are illustrated. As shown in FIG. 5, each assembly 111 includes a mounting bracket 100 and four mounting panels 41 secured to the bracket 100. In some embodiments, two mounting assemblies 111 may be needed to secure the RRUs 60, 60' and/or A2 modules 70 to a mounting structure 150 (see, e.g., FIGS. 6B and 7B and FIGS. 9A-9B).

In some embodiments, the RRU mounting assembly 111 may include one or more mounting panel stabilizers 120. The mounting panel stabilizer 120 may be secured to the free ends of two corresponding mounting panels 41 (i.e., the respective ends of the mounting panels 41 not secured to the mounting bracket 100). The stabilizers 120 may be secured to the mounting panels 41 with fasteners 122 (e.g., bolts or screws) inserted through the slots 49. The mounting panel stabilizers 120 may provide additional structural support to the mounting panels 41 (e.g., when an RRU 60, 60' and/or A2 module 70 is secured thereto) and help to reduce vibration of the mounting panels 41, and thus, reduce PIM.

Figure 6A:
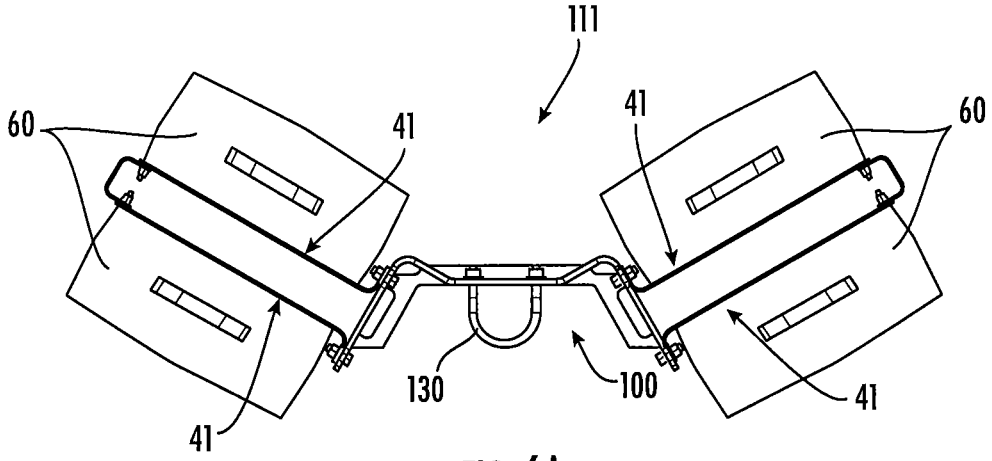
FIG. 6A is a top view of the mounting assembly of FIG. 5 with the mounting panels oriented with the flanges extending outwardly, and with four RRUs mounted thereon.
Figure 6B:
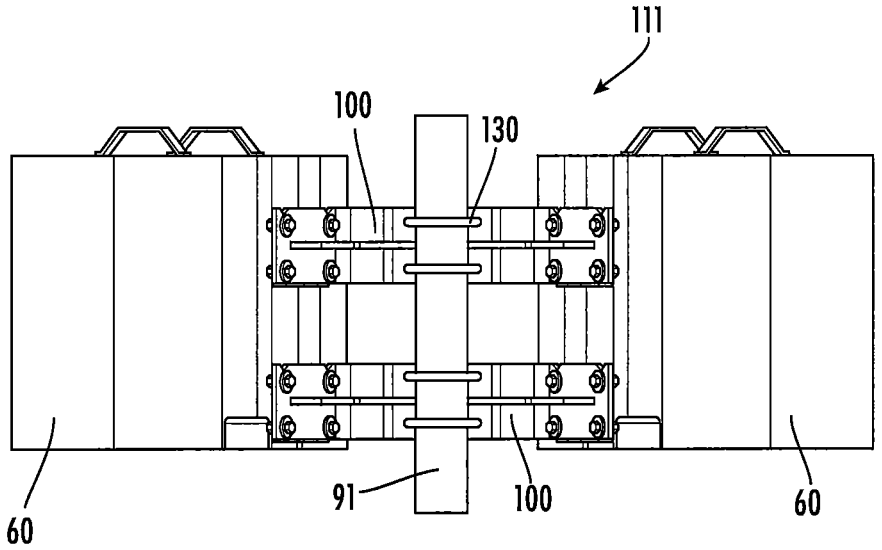
FIG. 6B is a rear view of the mounting assembly of FIG. 6A secured to a mounting structure.

Similar to the pipe clamps 13, 15 described herein, the configuration of the mounting bracket 100 and the mounting panels 41 enables the mounting panels 41 to be mounted either closely spaced from each other or more distantly spaced from each other. In each instance, a similar process of sliding the threaded bolts 53 with nuts 55 thereon into the slots 131, then aligning the holes 51, 133 and inserting another threaded bolt 53 is followed, except with the pipe clamps 13, 15 there are two open-ended slots 31, 33 for each mounting panel 41, whereas the mounting bracket 100 only has one open-ended slot 131 (i.e., on the top edge) for each mounting panel 41. If the mounting panels 41 are in the orientation shown in FIGS. 6A and 9A (i.e., with the flanges 45, 47 extending laterally, so that the flanges 45, 47 of the pair of mounting panels 41 extend away from each other), the mounting panels 41 are closely spaced from one other (typically between about 2 and 3 inches apart). In this orientation, the mounting panels 41 can provide mounting locations for two RRUs 60 in a "back-to-back" configuration, as shown in FIGS. 6A-6B.

Figure 7A:
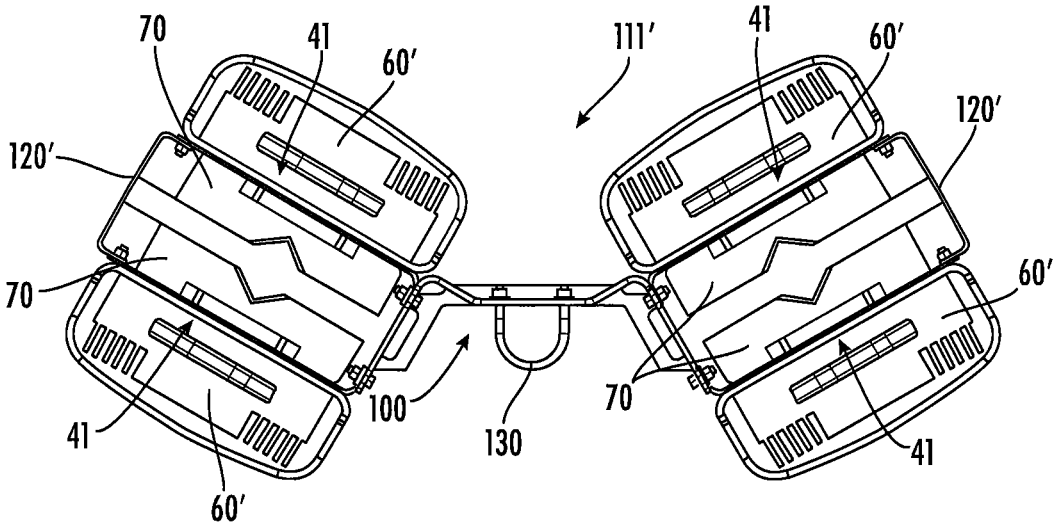
FIG. 7A is a top view of the mounting assembly of FIG. 5 with the mounting panels oriented with the flanges extending inwardly, and with four RRUs and four A2 modules mounted thereon.
Figure 7B:
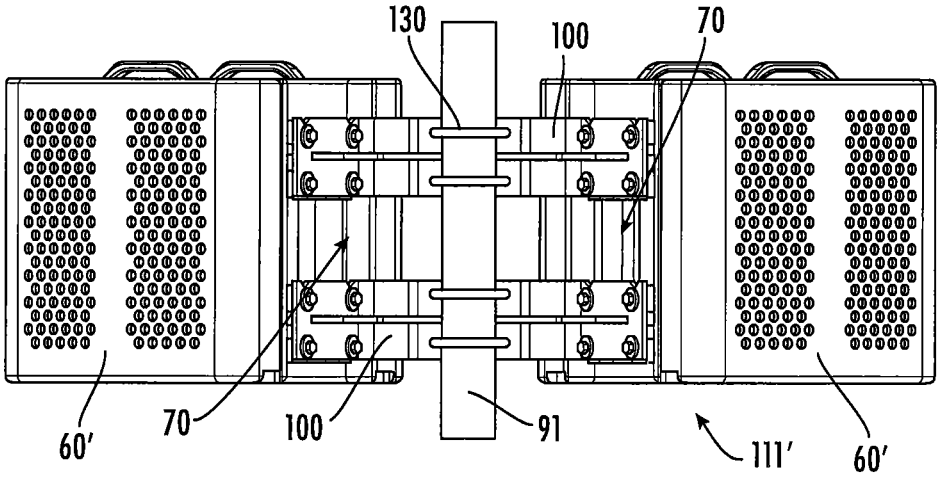
FIG. 7B is a rear view of the mounting assembly of FIG. 7A secured to a mounting structure.
Figure 9A:
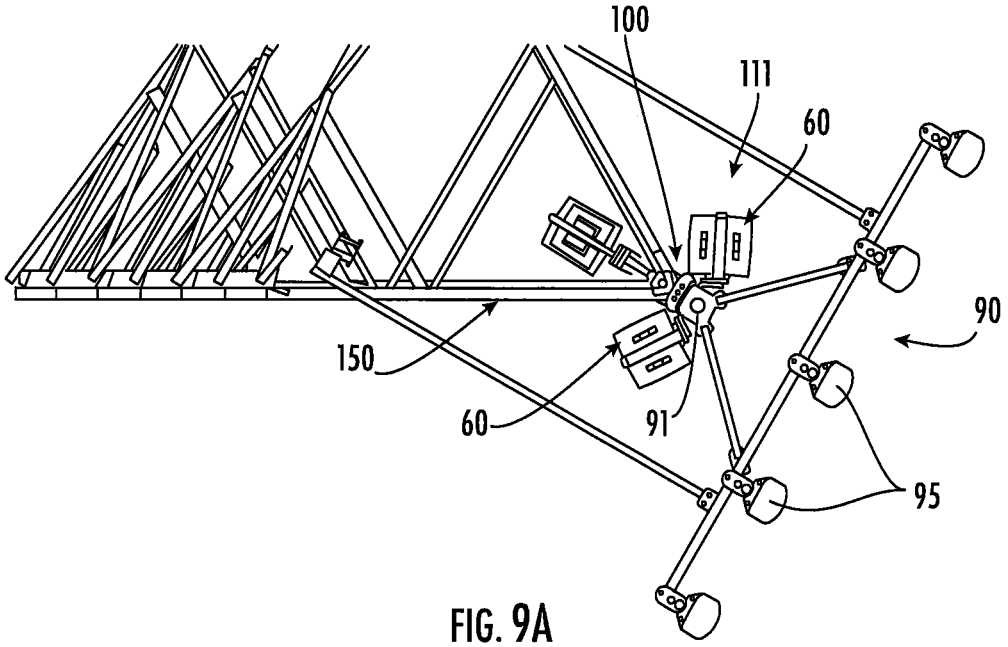
FIG. 9A is a top view of the mounting assembly of FIGS. 6A-6B, in combination with a sector frame mount, and secured to an antenna tower.
Figure 9B:
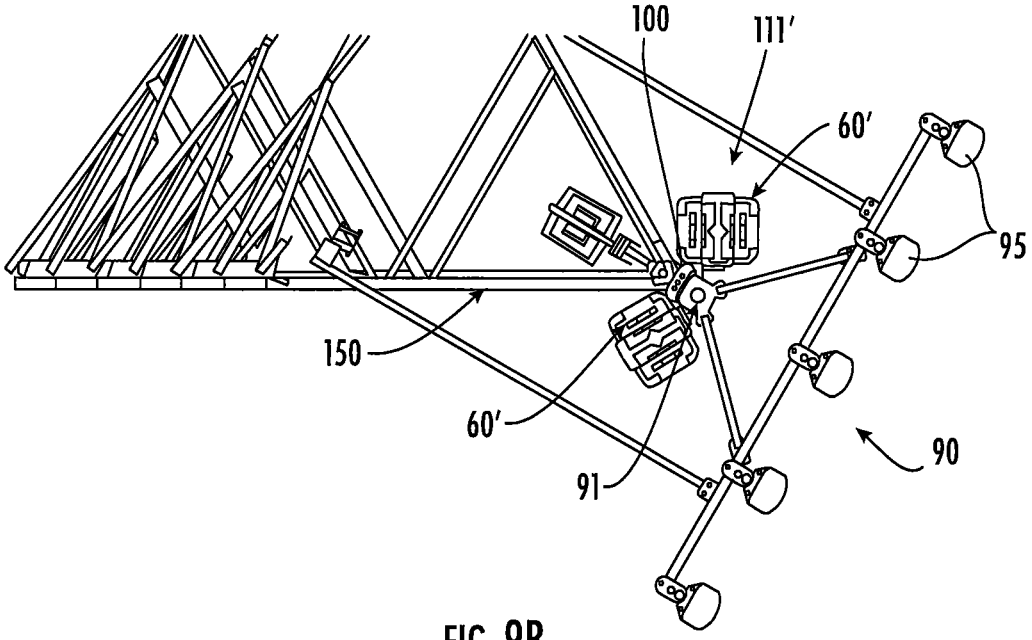
FIG. 9B is a top view of the mounting assembly of FIGS. 7A-7B, in combination with a sector frame mount, and secured to an antenna tower.

If instead the mounting panels 41 are in the orientation shown in FIGS. 7A and 9B (i.e., with the flanges 45, 47 extending inwardly toward the flanges 45, 47 of the other mounting panel 41), the mounting panels 41 are more distantly spaced from each other (i.e., between about 7 inches and 9 inches apart). In this orientation, the mounting panels 41 can provide mounting locations for two RRUs 60', with one RRU 60' located laterally from each mounting panel 41, and also for two A2 modules 70 sandwiched between the mounting panels 41, with one A2 module 70 mounted to each mounting panel 41, as shown in FIGS. 7A-7B. A larger (i.e., longer) mounting panel stabilizer 120' would be needed for this configuration.

Figure 8:
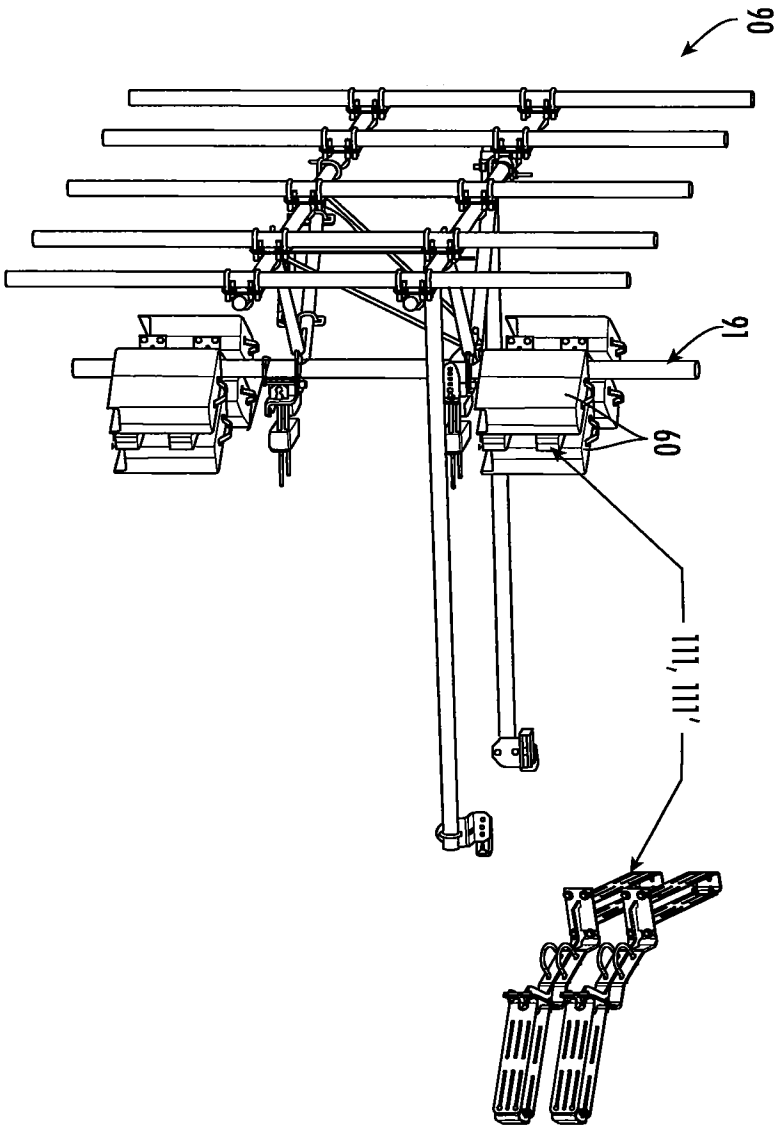
FIG. 8 is partial exploded view illustrating the mounting assembly of FIG. 5 secured to a sector frame mount.

FIG. 8 and FIGS. 9A-9B illustrate exemplary use of the RRU mounting assemblies 111, 111' according to embodiments of the present invention. As shown in FIG. 8, the RRU mounting assembly 111, 111' is secured to a spine pole 91 of a sector frame mount 90. As shown in FIGS. 9A-9B, the mounting bracket 100 of the RRU mounting assemblies 111, 111' allows the RRUs 60, 60' to be mounted away from the antennas 95 mounted on the sector frame mount 90 and on either side of the mounting structure 150 (i.e., the leg of an antenna tower).

Figure 10:
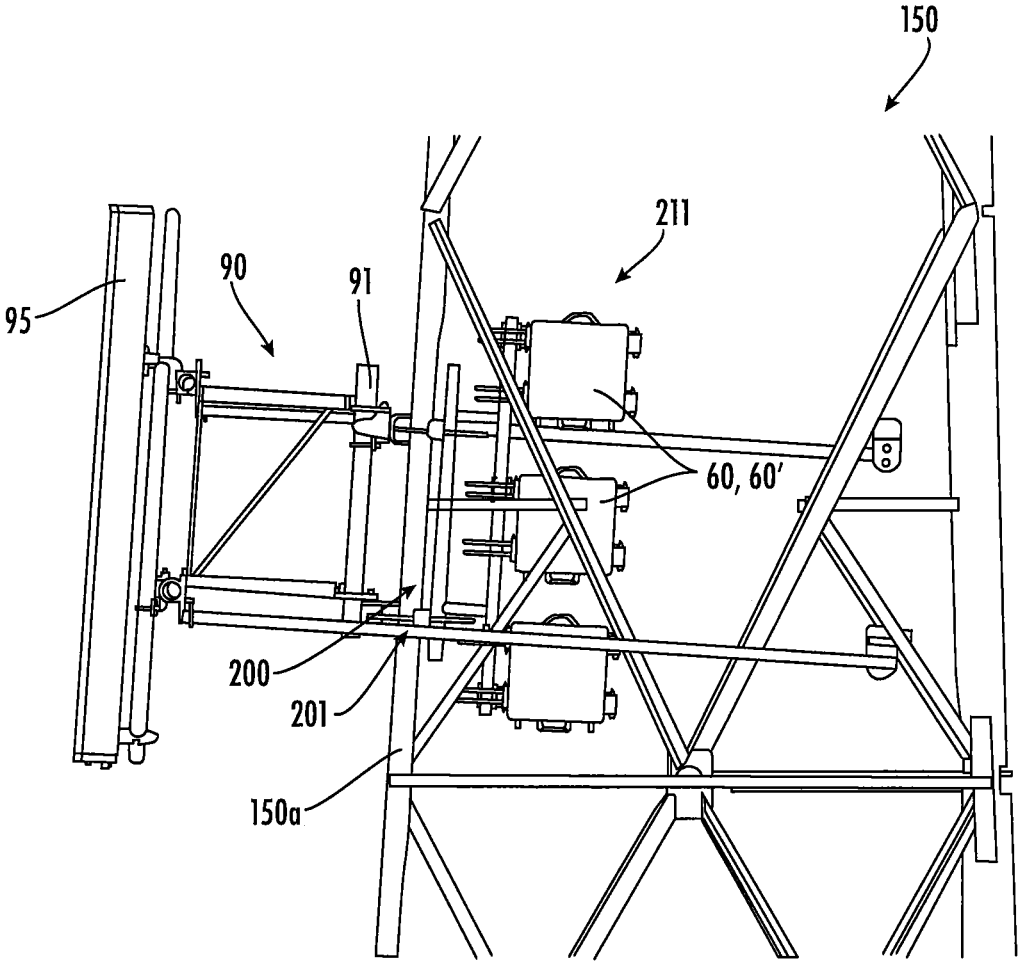
FIG. 10 is a side view of another RRU mounting assembly secured inside of an antenna tower leg according to embodiments of the present invention.
Figure 11A:
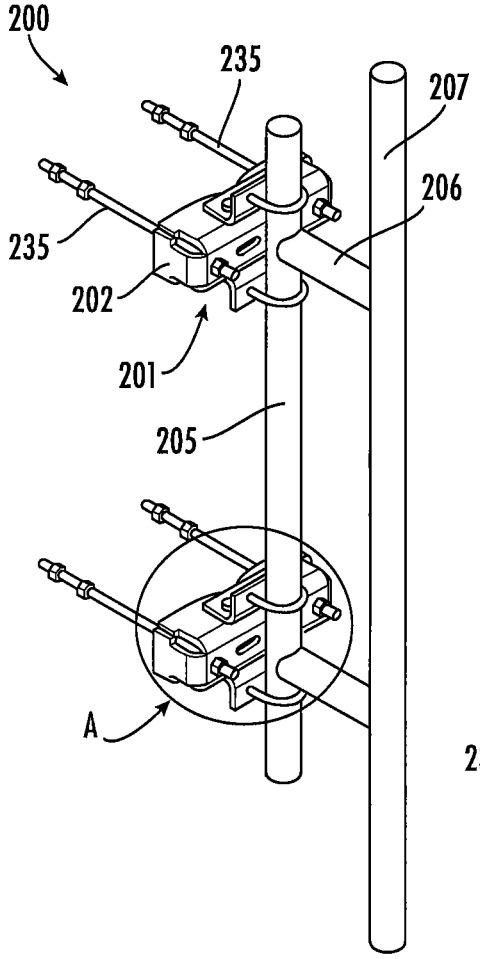
FIG. 11A is a perspective view of an RRU mount utilized in the RRU mounting assembly of FIG. 10.
Figure 11B:
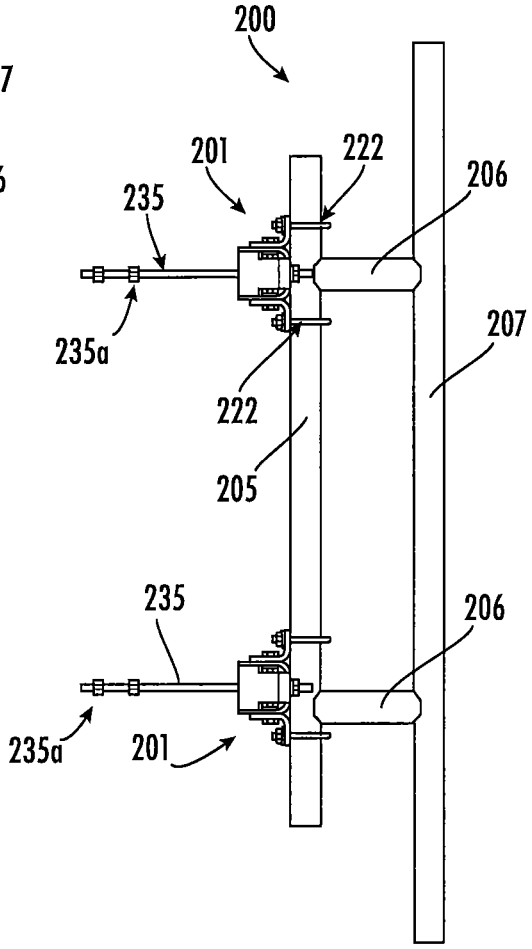
FIG. 11B is a side view of the RRU mount of FIG. 11A.
Figure 11C:
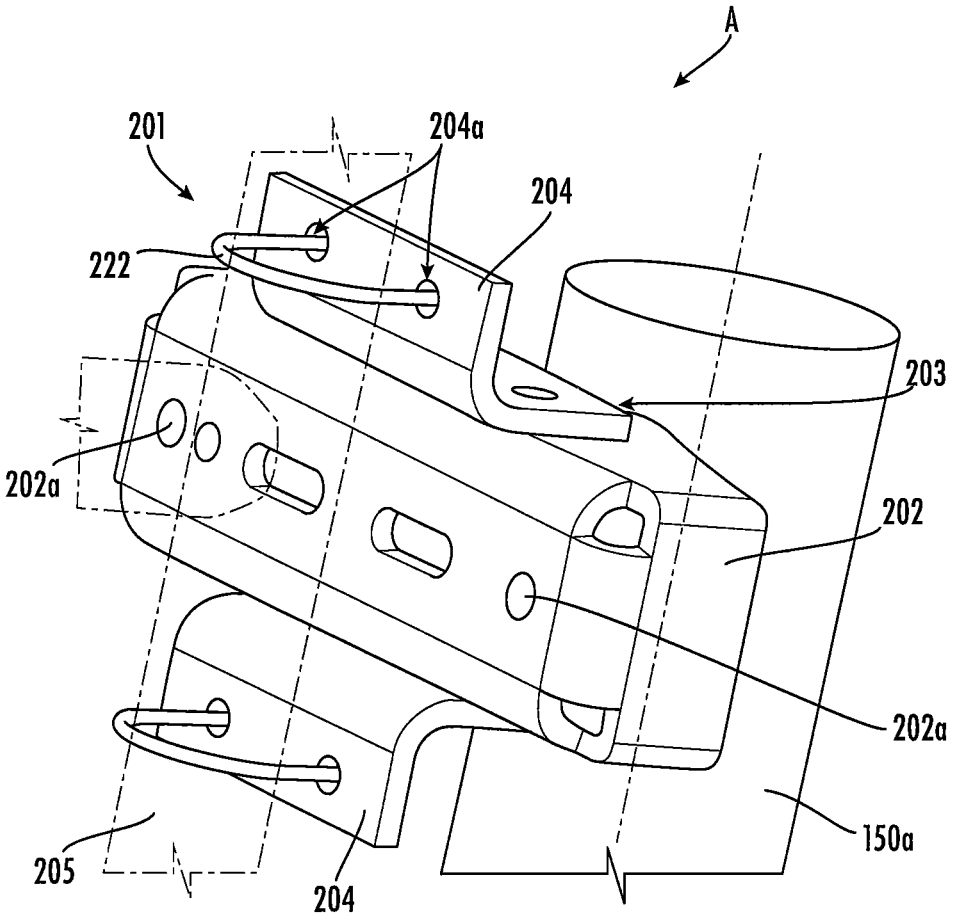
FIG. 11C is an enlarged view of the circled section labeled "A" in FIG. 11A.
Figure 12:
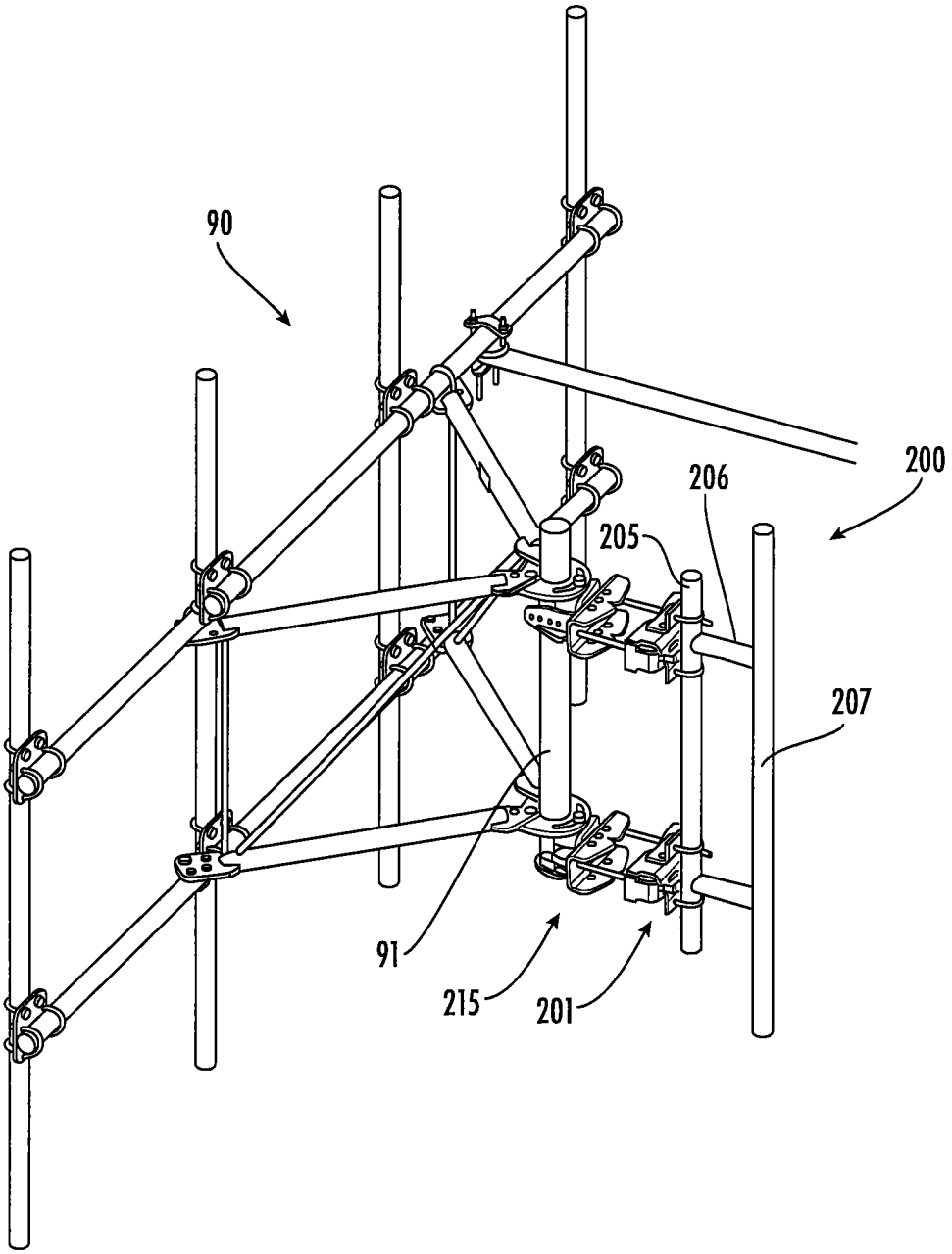
FIG. 12 is a perspective view of the RRU mount of FIGS. 11A-11C in combination with a sector frame mount.

Referring now to FIGS. 10-12, an another RRU mounting assembly 211 is illustrated. As shown in FIG. 10, according to embodiments of the present invention, the RRU mounting assembly 211 includes RRUs 60, 60' to be mounted such that the RRUs 60, 60' reside within the interior space of an antenna tower 150 (i.e., separate from the antennas 95), and in particular radially inward from the leg 150*a*. Repositioning the RRUs 60, 60' to a location that is away from being directly behind the antennas 95 may help to reduce PIM, while also reducing load weight on the sector frame mount 90. In addition, mounting the RRUs 60, 60' within the antenna tower footprint (radially inward of the antenna tower leg 150*a*) can reduce path interference high frontal EPA, which can reduce wind load on the assembly 211. In addition, positioning the RRUs 60, 60' within the antenna tower footprint allows for a technician to more safely access the RRUs 60, 60'.

FIGS. 11A-11C illustrate an RRU mount 200 according to embodiments of the present invention. In some embodiments, the RRU mount 200 may be utilized in the RRU mounting assembly 211. As shown in FIGS. 11A-11C, the RRU mount 200 may include a pair of saddle brackets 201. Each saddle bracket 201 comprises a main body 202 and two angle brackets 204 coupled to the main body 202. In some embodiments, the saddle brackets 201 are configured to secure the RRU mount 200 to the spine pole 91 of a sector frame mount 90 and the leg 150*a* of the antenna tower 150 (see, e.g., FIGS. 10 and 12). In some embodiments, the main body 202 of each saddle bracket 201 includes a recess 203. Similar to the front and rear pipe clamps 13, 15 described herein, as shown in FIG. 12, each saddle bracket 201 may be held together with a corresponding pipe clamp 215 by two threaded bolts or rods 235 that are inserted through aligned holes 202*a* located near the edges of the saddle bracket 201 and corresponding pipe clamp 215 and secured with nuts 235*a* (see also, e.g., FIGS. 11A-11C). Tightening of the bolts 235 enables the saddle brackets 201 and pipe clamps 215 to clamp the leg 150*a* of an antenna tower 150, with the tower leg 150*a* being held between recesses 203 in the saddle bracket 201 and pipe clamp 215.

As shown in FIG. 11C, each angle bracket 204 comprises a pair of mounting apertures 204*a*. The mounting apertures 204*a* are configured to receive a fastener 222 (e.g., a U-bolt). The fasteners 122 are configured to secure a first mounting pipe 205 to the RRU mount 200. In some embodiments, a pipe stand-off (or extension) 206 may couple a second mounting pipe 207 to the first mounting pipe 205. One or more RRUs 60, 60' may be secured to the second mounting pipe 207 (i.e., radially inward of the leg 150*a* of the antenna tower 150) (see, e.g., FIG. 10). In some embodiments, the RRUs 60, 60' may be secured to the mounting pipe 207 using the RRU mounting assembly 11 described herein (see, e.g., FIG. 1). In some embodiments, the RRU mount 200 may not include the pipe stand-off 206 and second mounting pipe 207, and instead the RRUs 60, 60' may be secured directly to the first mounting pipe 205.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An assembly for mounting one or more remote radio units to a mounting structure, comprising:

first and second mounting panels, each of the first and second mounting panels having a main body and a flange that extends generally perpendicularly to the main body, the main body including mounting apertures patterned for mounting of a remote radio unit;

a mounting bracket is generally W-shaped having a bracket section and a brace section, wherein the bracket section comprises a plurality of open-ended slots and mounting holes;

mounting members extending from the flanges away from the main body of each of the first and second mounting panels, wherein one mounting member for each mounting panel is configured to enter a corresponding open-ended slot on the mounting bracket and slide therein and another mounting member for each mounting panel is configured to be received through a corresponding mounting hole; and fasteners cooperating with the mounting members to mount the first and second mounting panels to the mounting bracket.

2. The assembly of claim 1, wherein the bracket section of the mounting bracket further comprises a slot configured to receive the brace section, and wherein the brace section is secured to the bracket section via welding.

3. The assembly of claim 1, wherein the apertures in the main bodies of the first and second mounting panels are aligned slots.

4. The assembly of claim 1, wherein the first and second mounting panels are mounted on the mounting bracket such that the flanges on the first mounting panel extend toward the flanges of the second mounting panel.

5. The assembly of claim 1, wherein the first and second mounting panels are mounted on the mounting bracket such that the flanges of the first mounting panel are mounted to extend away from the flanges of the second mounting panel.

6. The assembly of claim 1, further comprising a mounting panel stabilizer secured to the ends of the first and second mounting panels opposite to the flanges.

7. The assembly of claim 1, further comprising:

third and fourth mounting panels, each of the third and fourth mounting panels having a main body and a flange that extends generally perpendicularly to the main body, the main body including mounting apertures patterned for mounting of a remote radio unit, wherein fasteners cooperating with the mounting members to mount the third and fourth mounting panels to the mounting bracket.

8. The mounted remote radio unit pair of claim 7, further comprising first, second, third and fourth remote radio units, wherein the first and second remote radio units are mounted, respectively, to the first and second mounting panels, and wherein the third and fourth remote radio units are mounted, respectively, to the third and fourth mounting panels.

9. The assembly of claim 1, wherein the mounting members compress the flanges of the first, second, third, and fourth mounting panels against the mounting bracket.

10. The assembly of claim 1, wherein the first mounting panel includes a mounting extension mounted to the apertures and extending vertically therefrom, the mounting extension configured to mount to a remote radio unit.

11. A remote radio unit mounting assembly, comprising:

first and second remote radio units;

a mounting structure;

a mounting bracket secured to the mounting structure, the mounting bracket having a bracket section and a brace section, wherein the bracket section comprises a plurality of open-ended slots and mounting holes;

first and second mounting panels, each of the first and second mounting panels having a main body and a flange that extends generally perpendicularly to the main body, the main body including mounting apertures patterned for mounting of the remote radio units;

mounting members extending from the flanges away from the main body of each of the first and second mounting panels, wherein one mounting member for each mounting panel is received within a corresponding open-ended slot on the mounting bracket and another mounting member for each mounting panel is received through a corresponding mounting hole; and fasteners cooperating with the mounting members to mount the first and second mounting panels to the mounting bracket, wherein the first and second remote radio units are mounted on a respective mounting panel.

12. The remote radio unit mounting assembly of claim 11, wherein the mounting structure is a leg of an antenna tower, and the mounting bracket is generally W-shaped to allow one or more mounted RRUs to reside on either side of the leg of the antenna.

13. The remote radio unit mounting assembly of claim 11, further comprising:

third and fourth remote radio units; and third and fourth mounting panels, wherein fasteners cooperating with the mounting members to mount the third and fourth mounting panels to the mounting bracket, wherein the third and fourth remote radio units are mounted on a respective mounting panel.

14. A mounted remote radio unit pair, comprising:

first and second remote radio units; and a remote radio mounting assembly, the assembly comprising:

first and second mounting panels, each of the first and second mounting panels having a main body and a flange that extends generally perpendicularly to the main body, the main body including mounting apertures patterned for mounting of a remote radio unit;

a mounting bracket is generally W-shaped having a bracket section and a brace section, wherein the bracket section comprises a plurality of open-ended slots and mounting holes;

mounting members extending from the flanges away from the main body of each of the first and second mounting panels, wherein one mounting member for each mounting panel is configured to enter a corresponding open-ended slot on the mounting bracket and slide therein and another mounting member for each mounting panel is configured to be received through a corresponding mounting hole; and fasteners cooperating with the mounting members to mount the first and second mounting panels to the mounting bracket, wherein the first and second remote radio units are mounted, respectively, to the first and second mounting panels.

* * * * *